United States Patent [19]

Mieger

[11] 4,332,094

[45] Jun. 1, 1982

[54] HYDRAULIC LOCKING OF THE BOOM TO THE SWIVEL ARM OF AN EXCAVATOR, CRANE OR THE LIKE

[76] Inventor: Rolf Mieger, Heimstrasse 7, 7951 Kirchdorf, Iller, Fed. Rep. of Germany

[21] Appl. No.: 108,658

[22] Filed: Dec. 31, 1979

[30] Foreign Application Priority Data

Jan. 18, 1979 [DE] Fed. Rep. of Germany ..... 2901923

[51] Int. Cl.[3] ..... E02F 5/02

[52] U.S. Cl. ..... 37/103; 414/723; 414/686

[58] Field of Search ..... 37/103, 117.5; 414/723–724, 710, 715, 694, 742, 685–692, 680, 912; 172/273; 212/33

[56] References Cited

U.S. PATENT DOCUMENTS

| | | | |
|---|---|---|---|
| 3,034,587 | 5/1962 | Dorkins et al. | 414/694 X |
| 3,204,793 | 9/1965 | Lane | 414/723 X |
| 3,426,929 | 2/1969 | Vik | 414/715 |
| 3,653,131 | 4/1972 | Pilch | 414/694 X |
| 3,760,883 | 9/1973 | Birk | 414/723 X |

FOREIGN PATENT DOCUMENTS

| | | | |
|---|---|---|---|
| 642971 | 6/1962 | Canada | 37/103 |
| 814808 | 6/1969 | Canada | 172/273 |
| 2549416 | 5/1976 | Fed. Rep. of Germany | 414/686 |
| 2511819 | 9/1976 | Fed. Rep. of Germany | 37/103 |

*Primary Examiner*—E. H. Eickholt

*Attorney, Agent, or Firm*—Hedman, Casella, Gibson & Costigan

[57] ABSTRACT

In an excavator, crane or the like comprising a base structure, a swivel arm connected to said base structure and a boom attachment releasably locked to said swivel arm, releasable locking means for said boom attachment comprising at least two locking pins passing therethrough and through said swivel arm, said locking pins being linked to at least one hydraulic piston-cylinder unit for inserting them through and withdrawing them from said boom attachment and swivel arm.

11 Claims, 5 Drawing Figures

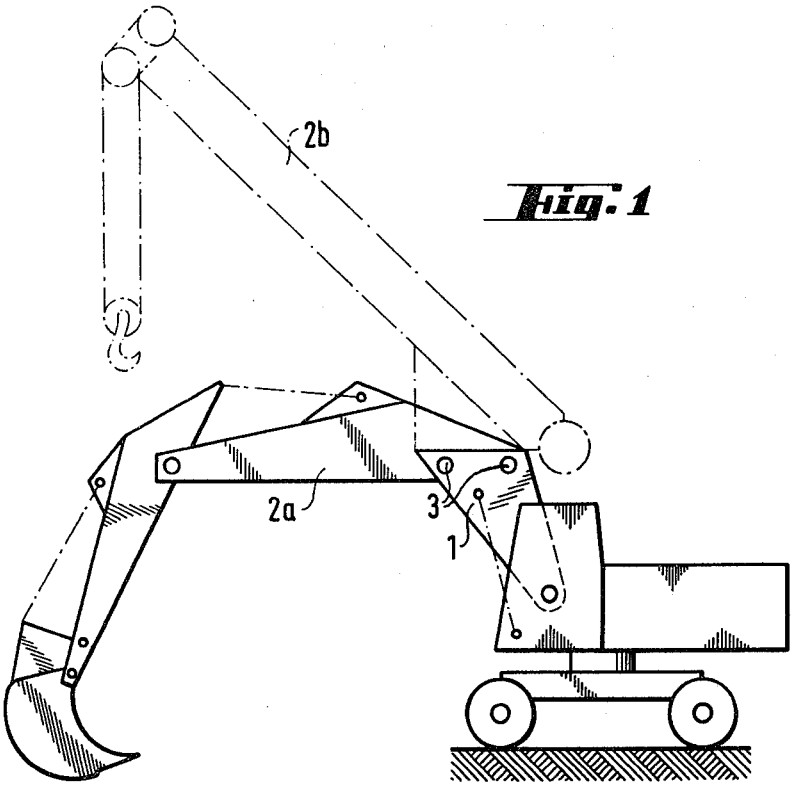
Fig. 1
Fig. 2
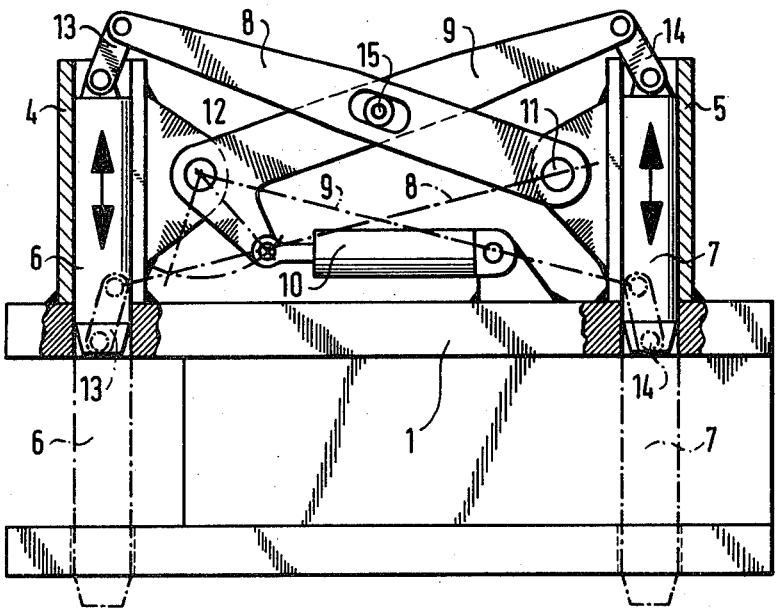

HYDRAULIC LOCKING OF THE BOOM TO THE SWIVEL ARM OF AN EXCAVATOR, CRANE OR THE LIKE

The invention relates to a hydraulic device for locking the boom to the swivel arm of an excavator, crane or the like by means of locking pins.

In practice, it has been conventional to bolt the boom to the swivel arm manually. Although a hydraulic bolt connection is also known, its construction as a single-shear joint is suitable only for taking up low forces or only one force component because the bolts are guided in a slot in one direction transverse to their longitudinal axis.

The invention is based on the problem of providing a locking device of the aforementioned kind with which it is possible to achieve a bolt connection capable of withstanding high loads and suitable for fixing various attachments.

According to the invention, this problem is solved in that two non-coaxial locking pins can be guided transversely through the swivel arm and boom by levers which are pivoted to the pins and are drivable by at least one hydraulic cylinder.

The advantages obtainable by means of the invention are that the locking device constitutes a high quality pin connection capable of withstanding high loads and permitting different attachments or modifications to be attached, the lugs required for locking the pins remaining unloaded during operation. Further, the locking device according to the invention is of simple construction and therefore cheap to produce. In addition, it is possible to install the locking device of the invention subsequently and to operate it from the driver's position without assistance from other persons. Should the hydraulic system fail, it is possible to effect locking manually. It follows from the stated advantages that conversion can be effected in shorter periods, accidents are avoided when converting to different attachments and there is a saving in personnel for conversion.

Further features of the invention are the subject of subsidiary claims.

The invention will now be described in more detail with reference to examples reproduced in the drawing, wherein:

FIG. 1 shows a basic structure with, for example, two different attachments which can be alternately locked to the swivel arm to fulfill their special purposes;

Figure 2A:
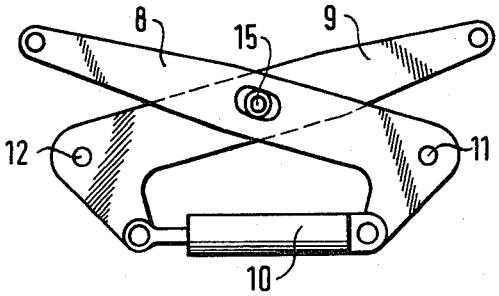
FIG. 2 shows the locking device.

FIGS. *2a, b, c* illustrate different embodiments for the actuation and parallel guiding of the locking device.

FIG. 1 shows a basic structure with a swivel arm 1 and a deep shovel backacter attachment comprising a boom *2a* secured to the swivel arm 1 by means of a locking device 3. To increase the versatility of the basic structure, it is possible to undo the locking device 3 and equip the basic structure with, for example, a crane jib *2b*.

The quick-acting hydraulic locking device provided on the swivel arm 1 consists of two guides 4 and 5 for the two locking pins 6 or 7, respectively. A respective lever 8 or 9 is hinged to each locking pin 6 or 7 by way of an intermediate link 13 or 14, the levers being driven by at least one hydraulic cylinder 10 in such a way that the locking pins are driven transversely through the swivel arm 1 during locking.

Figure 2B:
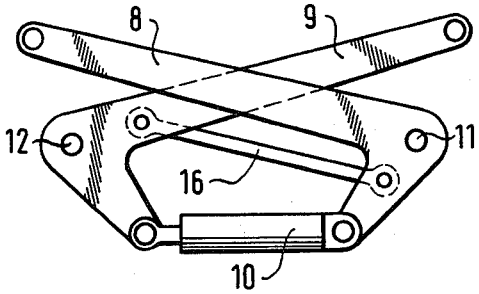
Figure 2C:
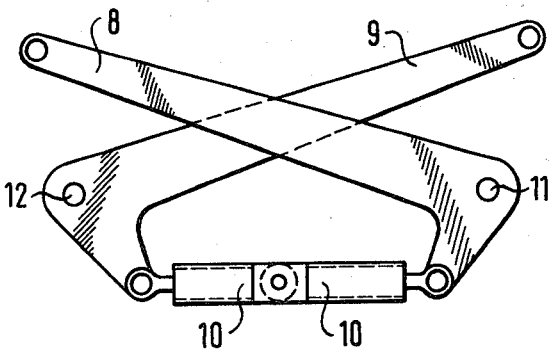

In the FIG. 2 embodiment, the hydraulic cylinder 10 is hinged to the swivel arm 1 on the one hand and to the lever 9 on the other hand. The levers 8 and 9 are in turn hinged to the guides 4 or 5 at their pivot points 11 or 12 and are interconnected, preferably by a synchronising guide 15.

In a different embodiment (FIG. *2a*), the hydraulic cylinder 10 is connected to the two levers 8 and 9 which, in turn, are interconnected, preferably likewise by a synchronising guide 15.

However, synchronisation can also be achieved in that the two levers are connected to a synchronising coupling element 16 (FIG. *2b*).

If the two locking pins are to be moved independently of each other, the levers are separately driven by a respective cylinder (FIG. *2c*).

I claim:

1. A hydraulic device for locking the boom to the swivel arm of an excavator, crane or the like by means of locking pins, characterized in that two non-coaxial locking pins (6 and 7) can be guided transversely through the swivel arm (1) and boom by two levers (8 or 9) which are pivoted to the pins and are drivable by a hydraulic cylinder (10), the hydraulic cylinder (10) being hinged to one of the levers (8) by its piston and to the other lever (9) by its piston rod.

2. A hydraulic device for locking the boom to the swivel arm of an excavator, crane or the like by means of locking pins, characterized in that two non-coaxial locking pins (6 and 7) can be guided transversely through the swivel arm (1) and boom by two levers (8 or 9) which are pivoted to the pins and are drivable by a hydraulic cylinder (10), said levers (8 and 9) being interconnected by a synchronizing coupling element (16) and said hydraulic cylinder (10) being hinged to one of the levers (8) by its piston and to the other lever (9) by its piston rod.

3. A hydraulic device for locking the boom to the swivel arm of an excavator, crane or the like by means of locking pins, characterized in that two non-coaxial locking pins (6 and 7) can be guided transversely through the swivel arm (1) and boom by two levers (8 or 9) which are pivoted to the pins and are drivable by at least one hydraulic cylinder (10), a first guide (4) being provided for locking pin (6) and being disposed on swivel arm (1), said first guide (4) being hinged to one said lever (9) at pivot point (12), a second guide (5) being provided for locking pin (7) and being disposed on swivel arm (1), said second guide (5) being hinged to the other said lever (8) at pivot point (11).

4. A hydraulic device for locking the boom to the swivel arm of an excavator, crane or the like by means of locking pins, characterized in that two non-coaxial locking pins (6 and 7) can be guided transversely through the swivel arm (1) and boom by two levers (8 or 9) which are pivoted to the pins and are drivable by a hydraulic cylinder (10), said levers (8 and 9) being interconnected by a synchronizing coupling element (16), a first guide (4) being provided for locking pin (6) and being disposed on swivel arm (1), said first guide (4) being hinged to one said lever (9) at pivot point (12), a second guide (5) being provided for the other locking pin (7) and being disposed on swivel arm (1), said second guide (5) being hinged to the other lever (8) at pivot point (11).

5. A hydraulic device for locking the boom to the swivel arm of an excavator, crane or the like by means of locking pins, characterized in that two non-coaxial locking pins (6 and 7) can be guided transversely through the swivel arm (1) and boom by two levers (8 or 9) which are pivoted to the pins and are drivable by a hydraulic cylinder (10), the hydraulic cylinder (10) being hinged to one said lever (8) by its piston and to the other said lever (9) by its piston rod, a first guide (4) being provided for one said locking pin (6) and being disposed on the swivel arm (1), said first guide (4) being hinged to one said lever (9) at pivot point (12), a second guide (5) being provided for the other said locking pin (7) and being disposed on the swivel arm (1), said second guide (5) being hinged to the other said lever (8) at pivot point (11).

6. A hydraulic device for locking the boom to the swivel arm of an excavator, crane or the like by means of locking pins, characterized in that two non-coaxial locking pins (6 and 7) can be guided transversely through the swivel arm (1) and boom by two levers (8 or 9) which are pivoted to the pins and are drivable by a hydraulic cylinder (10), said levers (8 and 9) being interconnected by a synchronizing coupling element (16), the hydraulic cylinder (10) being hinged to one said lever (8) by its piston and to the other said lever (9) by its piston rod, a first guide (4) being provided for one said locking pin (6) and being disposed on the swivel arm (1), said first guide (4) being hinged to one said lever (9) at pivot point (12), a second guide (5) being provided for the other said locking pin (7) and being disposed on the swivel arm (1), said second guide (5) being hinged to the other said lever (8) at pivot point (11).

7. The locking device of claim 1 or claim 3, characterized in that the levers (8 and 9) are connected to the locking pins (6 or 7) by a respective intermediate link (13 or 14).

8. The locking device of claim 1 or claim 3, characterized in that the two levers (8 and 9) are interconnected by a synchronizing guide (15).

9. The locking device of claim 7, characterized in that the two levers (8 and 9) are interconnected by a synchronizing guide (15).

10. The locking device of claim 3 or claim 4, characterized in that the hydraulic cylinder (10) is hinged at one end to the swivel arm (1) and at the other end to one of the levers (9).

11. The locking device of claim 3 characterized in that each of the levers (8 and 9) are separately driven by respective hydraulic cylinders.

* * * * *